US006259375B1

(12) United States Patent
Andras

(10) Patent No.: US 6,259,375 B1
(45) Date of Patent: Jul. 10, 2001

(54) HIGHWAY WARNING SYSTEM

(76) Inventor: Roger J. Andras, 112 Skyward Dr., Danville, PA (US) 17821

( * ) Notice: Subject to any disclaimer, the term of this patent is extended or adjusted under 35 U.S.C. 154(b) by 0 days.

(21) Appl. No.: 09/592,654

(22) Filed: Jun. 13, 2000

Related U.S. Application Data

(63) Continuation-in-part of application No. 09/522,990, filed on Mar. 9, 2000.

(51) Int. Cl.[7] ..... G08G 1/095

(52) U.S. Cl. ..... 340/907; 340/321; 340/427; 340/907; 340/908; 340/908.1; 340/917

(58) Field of Search ..... 340/907, 908.1, 340/908, 427, 321, 917, 942

(56) References Cited

U.S. PATENT DOCUMENTS

| | | | | |
|---|---|---|---|---|
| 2,162,302 | | 6/1939 | Greene | 302/329 |
| 2,270,134 | | 1/1942 | Meador | 40/133 |
| 3,273,115 | | 9/1966 | Lafon | 340/41 |
| 3,585,585 | | 6/1971 | Grosz | 340/114 |
| 3,593,261 | | 7/1971 | Dominguez | 340/36 |
| 3,798,743 | * | 3/1974 | Griwold | 29/428 |
| 4,208,090 | * | 6/1980 | Heenan | 350/61 |
| 4,907,139 | * | 3/1990 | Quioque | 362/153 |
| 4,929,942 | * | 5/1990 | Niimi | 340/908.1 |
| 5,059,060 | * | 10/1991 | Steinhardt | 404/11 |
| 5,801,646 | | 9/1998 | Pena | 340/902 |
| 5,816,737 | | 10/1998 | Siblik | 404/13 |
| 5,839,816 | * | 11/1998 | Varga et al. | 362/153.1 |
| 5,927,845 | | 7/1999 | Gustafson et al. | 362/152 |
| 6,092,909 | * | 7/2000 | Sools et al. | 362/153.1 |

* cited by examiner

*Primary Examiner*—Jeffery Hofsass
*Assistant Examiner*—Hung Nguyen
(74) *Attorney, Agent, or Firm*—Jacobson Holman, PLLC

(57) ABSTRACT

A warning system in the highway or road immediately adjacent to a pedestrian crossing, school crossing, or railroad grade crossing. The embedded warning system consists of a series of strobe lights powered by a nearby electrical source such as a traffic light, flashing warning light, railroad crossing light and/or gate system or other potential source of electricity. A trough containing the lights is submerged, extending to a depth of 9 to 15 inches below grade. The trough is 8 to 12 feet in length and 5 inches wide. The trough is placed parallel to or perpendicular to the direction of traffic so as to cross the path of oncoming traffic. A series of 4 to 9 strobe lights connected together, having a colored filter of amber or red, is placed along the bottom of the trough. The sides and bottom of the trough are lined with a reflective material made of, for example, highway reflective light beads, a highly polished reflective material, or other reflective material. The top of the trough is sealed with a double layer of plastic material. The sides of the trough are rounded to facilitate placement of the trough in an excavated ditch.

21 Claims, 8 Drawing Sheets

HIGHWAY WARNING SYSTEM

This application is a continuation-in-part of application Ser. No. 09/522,990, filed Mar. 9, 2000.

FIELD OF THE INVENTION

The present invention relates to a system for warning oncoming traffic of a potentially dangerous road crossing area, including school crossing zones, railroad crossings or other locations.

BACKGROUND OF THE INVENTION

In the U.S., there are approximately 268,000 highway-rail and pedestrian crossings. In an average year, more people die at highway-rail grade crossings than in commercial airline crashes. Oftentimes, the cause of a highway-rail or pedestrian crossing accident is that the driver fails to pay attention to highway conditions.

Most of the highway-rail and pedestrian crossing accidents are preventable. Despite present measures such as traffic lights, stop signs, rail crossing lights (cross-buck signs), railroad gates or other markings, signs or indicators of the potentially dangerous highway location, accidents continue to occur.

Many drivers fail to pay attention to traffic signals because of their location on the side of the road and also because the signals are difficult to see in fog. However, most drivers, even when not paying close attention, do look at the road when driving and would tend to notice a highway warning system embedded in the roadway.

SUMMARY OF THE INVENTION

Accordingly, it is an object of the present invention to provide a warning system in the highway or road immediately adjacent to a pedestrian crossing, school crossing, or railroad grade crossing The embedded warning system consists of a series of strobe lights powered by a nearby electrical source such as a traffic light, flashing warning light, railroad crossing light and/or gate system or other potential source of electricity. Alternatively, a solar panel and battery recharging apparatus may be used as a source of power.

A trough containing the lights is located so that its uppermost surface is at or slightly above grade, extending to a depth of 9 to 15 inches below grade. The trough is 8 to 12 feet in length and 3 to 12, and preferably 5 inches wide. The trough is placed perpendicular to the direction of traffic so as to cross the path of oncoming traffic and preferably is placed parallel with the direction of traffic. The strobe lights flash at a rate of 30 to 120 flashes per minute, and preferably 60 flashes per minute.

To accommodate most trenching tools, the end caps of the trough would be rounded. This allows the trough to quickly be inserted into an excavated trough without labor intensive squaring off of the ends of the trough.

Preferably one or two troughs are placed parallel to the direction of travel. Preferably, in a four lane road, two sets of two parallel trough sets are located in one direction of traffic with a single-trough in the middle of a lane of traffic, with two spaced rows of two troughs. Another two sets of two parallel trough sets are similarly placed in the opposite direction of travel.

A series of 4 to 9 strobe lights connected together, is having a colored filter of amber or red, is placed along the bottom of the trough. When two sets of troughs are used, the first set encountered by overcoming traffic may include amber colored filters as a warning light to urge oncoming traffic to slow down. The second set of troughs would include red colored filters to urge oncoming traffic to stop.

The sides and bottom of the trough are made of metal or plastic and are lined with a reflective material. The reflective material may be for example, highway reflective light beads, a highly polished reflective material, or other reflective material.

The top of the trough is sealed with a single or a double layer of plastic material. In a double layer configuration, the lowermost layer is approximately 1 to 2 inches thick and is transparent. The upper layer, which is at grade level, has a thickness of approximately 1 to 2 inch. Alternatively, where laws permit, the upper layer of plastic projects above the grade and is of a curved configuration having a thickness of 1½ to 3 inches.

The upper layer is transparent or translucent, and preferably transparent. Where the upper surface of the upper layer of plastic is curved, the upper layer also acts as a "speed bump" to slow oncoming traffic. The upper layer may include a honeycomb or prism structure to reflect and disperse light.

The trough is divided into a plurality of sections which are hermetically sealed from each other except for waterproof electrical communication. In the event that one section of the trough is compromised and exposed to the elements, causing failure of one section of strobe lights, the remaining sections of strobe lights will continue to function to provide a warning effect until repairs can be implemented. In this event, the top of the trough is removable for servicing.

The connection to the power supply provided by warning lights at a school crossing or a railroad crossing, for example, would be made such that the strobe lights and the trough would be synchronized to be activated at the same time as a crossing signal at a school crossing is activated or upon activation of railroad warning lights at a railroad crossing. This feature provides a coordinated effort to alert oncoming traffic of a potential danger.

Accordingly, it is another object of the present invention to provide a highway warning system extending parallel to the flow of traffic and providing a visual warning against continued or high speed traffic travel.

It is another object of the present invention to provide a highway warning system including a trough housing having a plurality of strobe lights activated in coordination with another highway warning system.

It is still yet another object of the present invention to provide a highway warning system including a trough having a plurality of strobe lights aimed to flash through a protective plastic covering optionally having a curved uppermost surface to provide a speed bump deterrent to continued traffic travel.

It is still yet another object of the present invention to provide a highway warning system extending parallel to the direction of flow of traffic and located adjacent to another highway warning device and triggered by the other highway warning device to flash a colored strobe light from below the grade level through a transparent or translucent cover of the trough so as to visually alert oncoming traffic to a potentially dangerous traffic situation.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
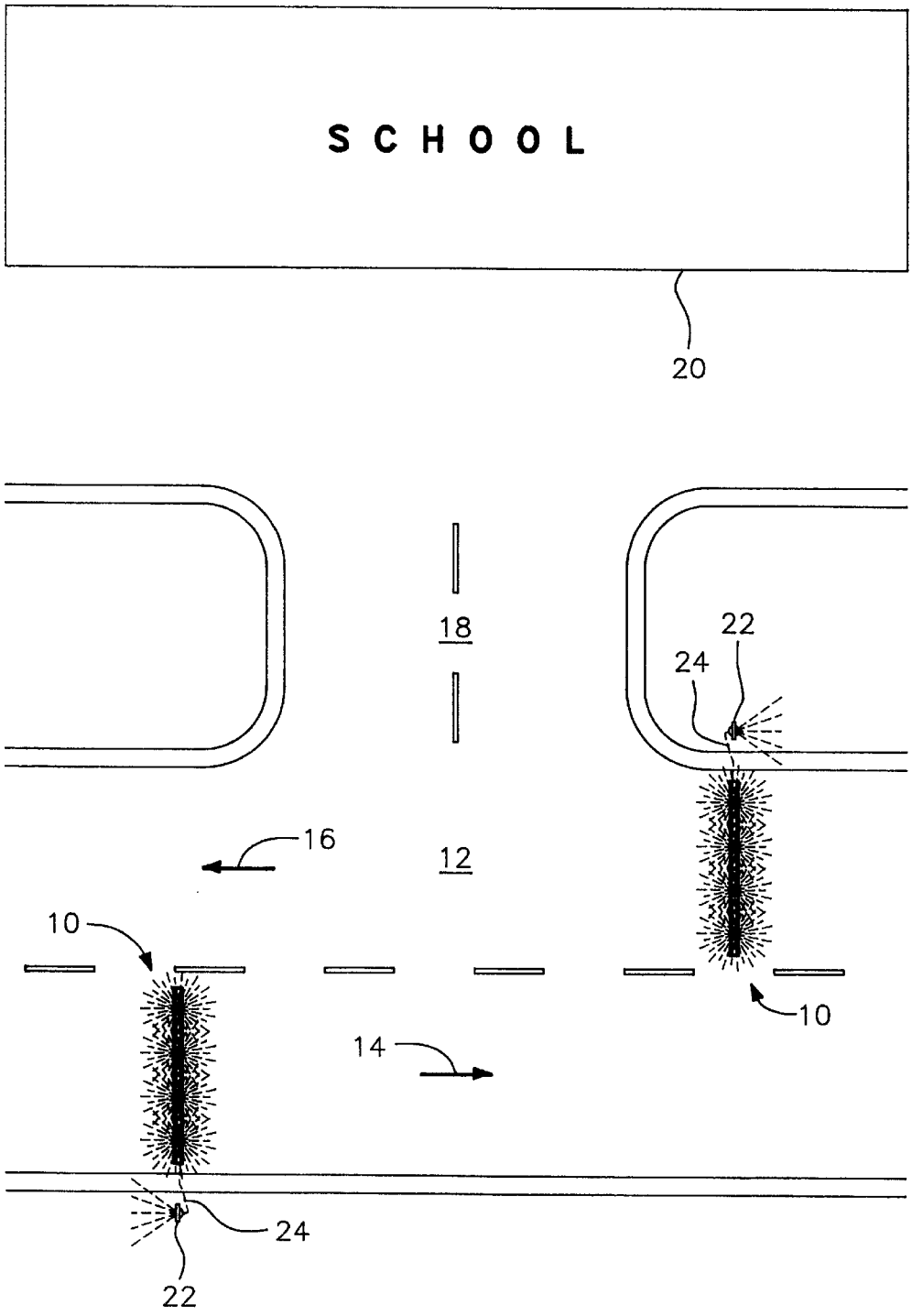
FIG. 1 is a plan view of the highway warning system of the present invention installed adjacent to a traffic crossing for a school.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar mariner to accomplish a similar purpose.

Figure 2:
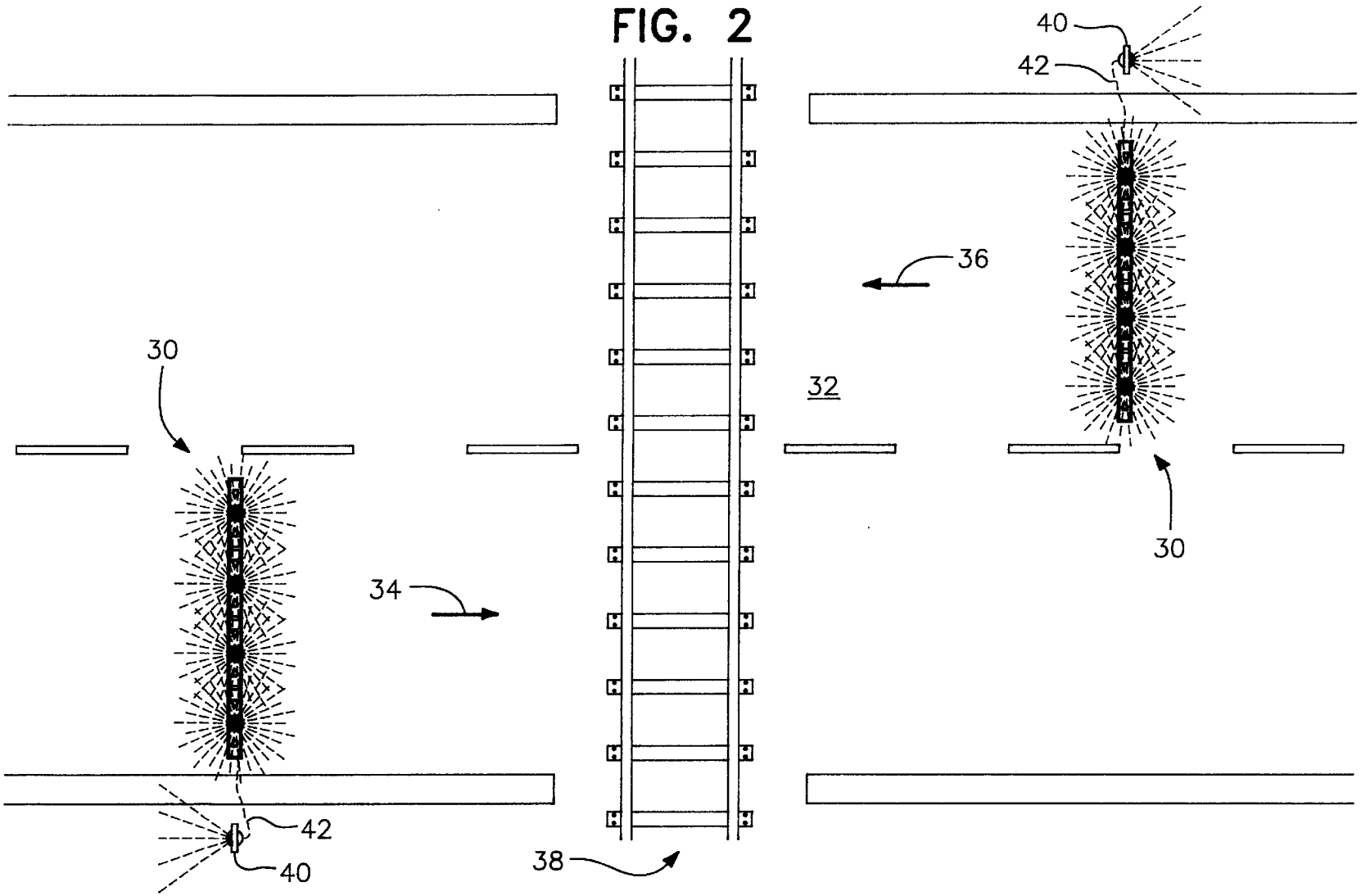
FIG. 2 is a plan view of the highway warning system of the present invention installed in a highway located adjacent to a railroad crossing.

With reference to the drawings, in general, and to FIGS. 1 and 2, in particular, a highway warning system embodying the teachings of the subject invention is generally designated. as 10. With reference to its orientation in FIG. 1, the highway warning system 10 is located in a roadway 12 having traffic moving in the direction of arrow 14 as well as traffic moving in the opposite direction as indicated by arrow 16.

In FIG. 1, two highway warning systems 10 are located in a roadway on opposite sides of an entranceway 18 to a school 20. The highway warning systems are each located adjacent to a traffic signal 22 used to control the flow of traffic by the traditional green, yellow, and red light system. Alternatively, electrical signal device 22 could be, in this instance, a warning light for warning drivers that they are approaching a school zone and that their speed should be reduced to, for example, 15 miles per hour.

To ensure that the drivers moving along roadway 12 in the direction of arrows 14 and 16 recognize that they are in a school zone and that it is imperative that their speed be reduced for the safety of children that may be crossing the roadway 12, the two warning systems 10, located on the opposite sides of the roadway, are embedded in the roadway 12, and positioned perpendicular to the flow of traffic on the roadway 12.

As shown in dotted lines in FIG. 1, electrical wire 24 connects the highway warning system 10 with the electrical signal device 22. The electrical connection between signal device 22 and the highway warning system 10 is controlled so that the highway warning system will be activated when for example, the signal device 22, when being a traffic light, is in a red or stop signal mode. Alternatively, when the signal device 22 is a flashing yellow caution sign, energized during morning school starting times and afternoon school closing times, the highway warning system 10 will simultaneously be activated.

In FIG. 2, two highway warning systems 30 are embedded in roadway 32 on which traffic travels in the direction of arrow 34 and arrow 36. The highway warning systems 30 extend perpendicular to the direction of travel indicated by the arrows 34 and 36.

In FIG. 2, a railroad track 38 traverses the road 32. An electrical signal device 40, such as a flashing red light with a sign indicating the presence of a railroad crossing, is located on the side of the road 32 with the highway warning systems 30 positioned adjacent to the signal devices 40. As in FIG. 1, an electrical wire 42 connects the power source of the signal device 40 to the highway warning systems 30.

When the signal devices 40 are activated, such as to indicate the presence of an oncoming train, the highway warning systems 30 will similarly be activated to warn oncoming traffic of the potential danger of a passing train. Therefore, even if a driver of an automobile does not notice the signal device 40 on the side of the road, the highway warning system 30 embedded in the roadway over which they must travel, will visually and physically alert the driver to the presence of a potentially hazardous condition.

The details of the highway warning system of the present invention will be described with reference to FIGS. 3 through 6.

Figure 3:
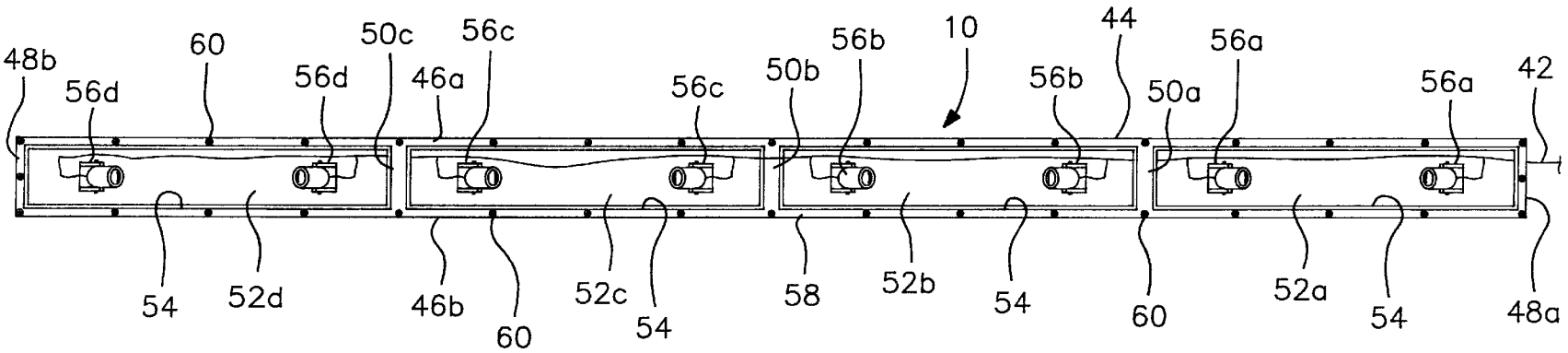
FIG. 3 is a plan view of the highway warning system of the present invention illustrating a plurality of divided sections, each including two strobe lights and being electrically interconnected.

In FIG. 3, a highway warning system 10 is shown which has an overall length of 8 to 11 feet and is 5 to 9 inches wide. The depth is approximately 12 inches. The sides and bottom are constructed of steel or plastic material to form container 44. The container 44 includes sidewalls 46*a*, 46*b*and end walls 48*a*, 48*b*. The thickness of these walls is ¼ to ½ inch.

Spaced along the length of the container 44 are three partitions 50*a*, 50*b*, 50*c* which divide the container 44 into four compartments 52*a*, 52*b*, 52*c*, 52*d*. Lining the interior of the compartments is a reflective material liner 54, At the base of each compartment are two strobe lights 56*a*, 56*b*, 56*c* and 56*d*, respectively. Interconnecting the strobe lights in each compartment, with reference to FIG. 2, is electric wire 42 entering through sidewall 48*a* and extending through each compartment and to each strobe light in each compartment. The wire is of a waterproof type such that if one of the compartments allows ground water or rain water to seep into a compartment resulting in damage to the strobe lights in that compartment, the remaining strobe lights in the other compartments will still operate and serve to warn oncoming traffic. Spaced along the top edge 58 of the container 44 are a plurality of bolts, the bolt heads 60 being shown in FIGS. 3 and 4.

Figure 4:
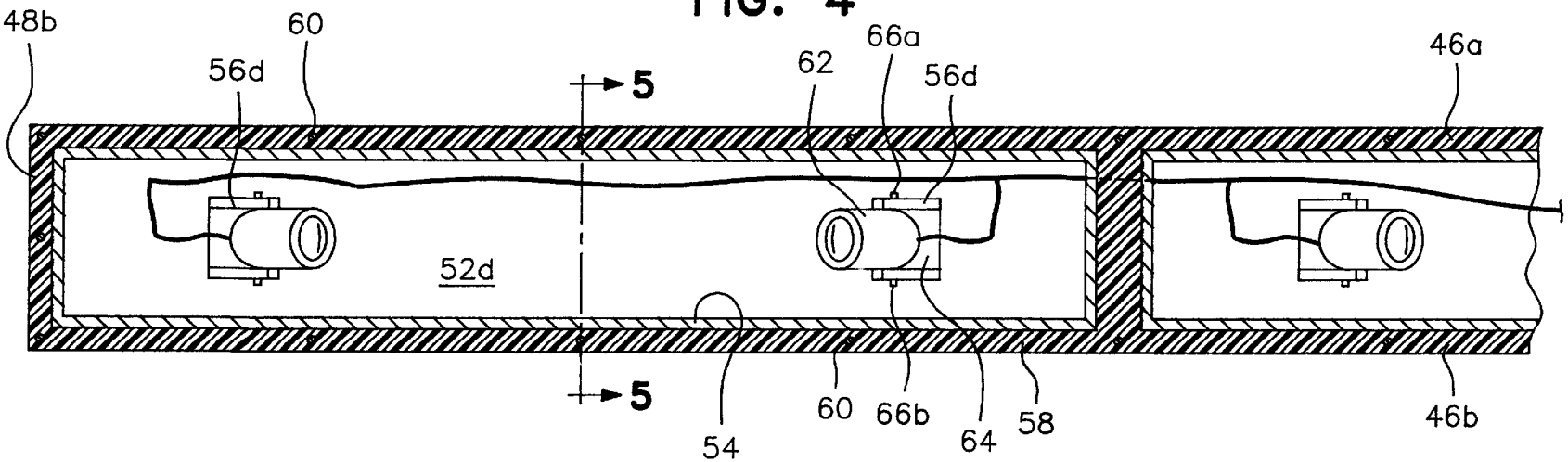
FIG. 4 is an enlarged cross-sectional view of a portion of the highway warning system of the present invention illustrating the trough components and interior reflective layer surrounding two strobe lights in each section of the trough.

As shown in FIG. 4, the strobe lights 56*d* include a light housing 62 mounted on a base 64 by pivot pins 66*a*, 66*b*. The pivot pins allow the light housing 62 to be pivoted to an optimal position for projecting light through the cover of the container as will be explained with reference to FIGS. 5 and 6.

Figure 5:
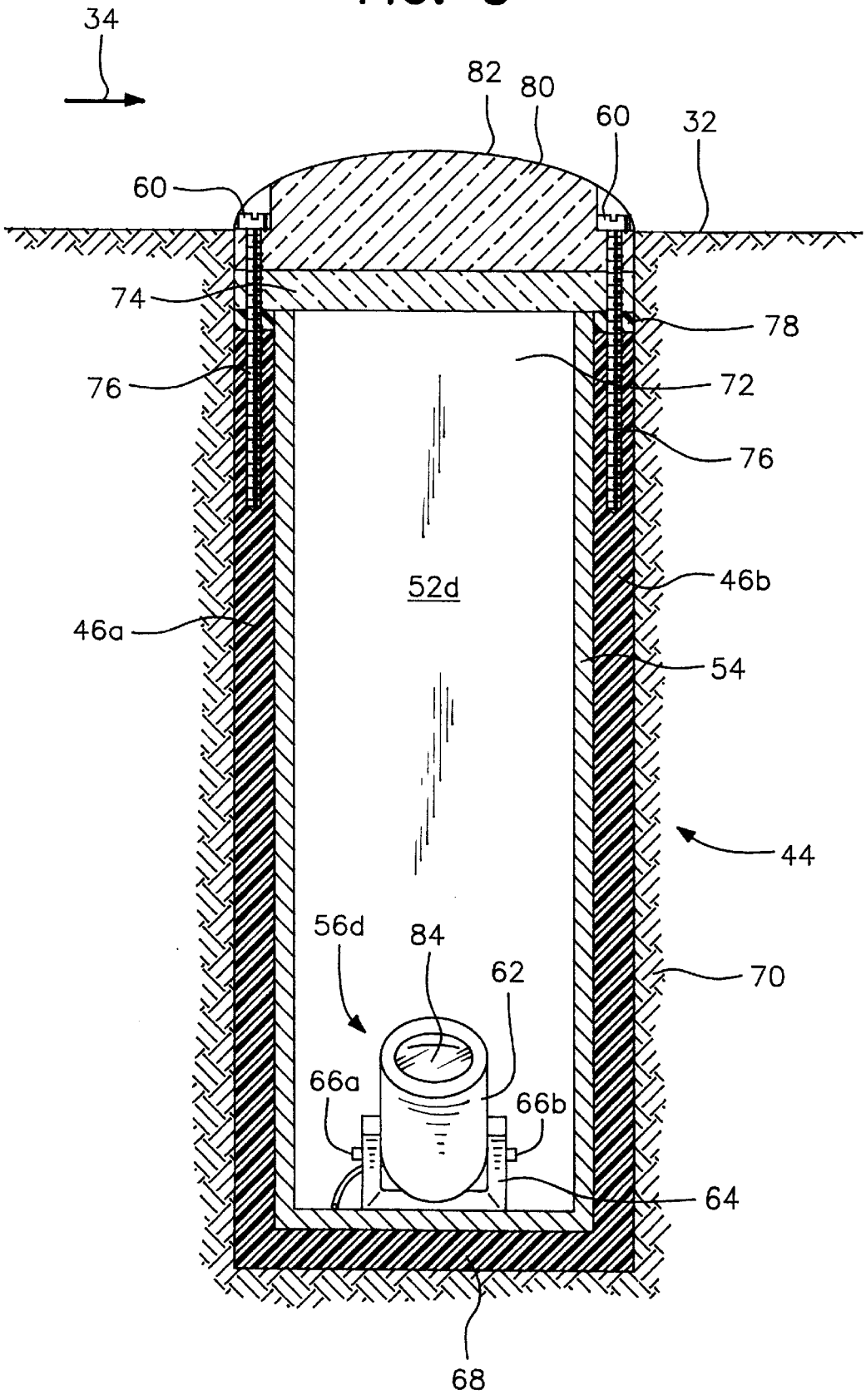
FIG. 5 is a sectional view taken along line 5—5 of FIG. 4.

In FIG. 5, a container 44 is shown buried in the roadway 32 at grade. The sidewalls 46*a*, 46*b* are shown along with the bottom 68 also being shown buried in the earth 70. At the top side 72 of the container, which is open, a first cover plate 74 is secured by bolts 76, having exposed heads 60. Cover plate 74 is approximately 1 to 1½ inches thick and has a rubber sealing gasket 78 compressed by the bolts 76 to seal the interior of the container 44. Located above the cover plate 74 is a second cover plate 80 of approximately 2 to 3 inches in thickness and having a continuously curved exterior surface 82.

Figure 6:
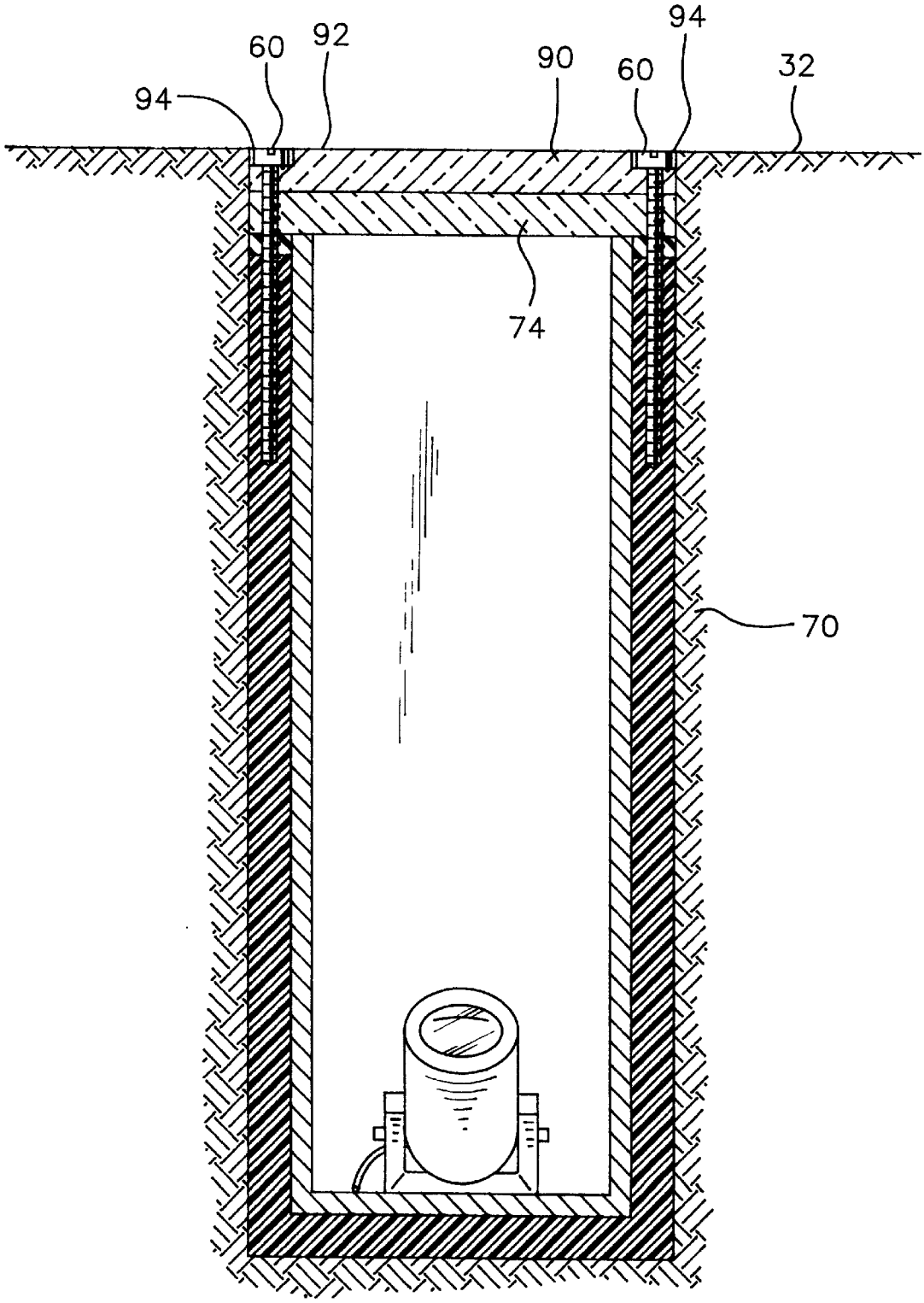
FIG. 6 is an alternate sectional view taken along line 5—5 of FIG. 4.

The curvature of the cover plate 80, where allowed by law, provides an impact speed bump to the traffic traveling in the direction of arrow 34 so as to physically alert the driver of an impending potentially hazardous condition. In addition, the strobe lights 56 are synchronized to flash continuously when activated by an electrical signal device located on the side of a roadway. The strobe lights 56 may include a filter 84 of amber or red color to further accentuate to the driver of an automobile a visual warning of a potentially hazardous condition immediately ahead.

Where curvature of the cover plate is prohibited by law, for example, where allowable speeds on a roadway are above a predetermined threshold, the cover plate 90, as shown in FIG. 6, has a flat upper surface 92. Screw heads 60 are recessed into recesses 94. Higher speed travel is then permitted as compared to the arrangement shown in FIG. 5. In this instance, the entire warning system would be set back further, as compared to the system shown in FIG. 5, from the school crossing or railroad crossing to allow more braking room for traffic traveling at higher speeds.

Figure 7:
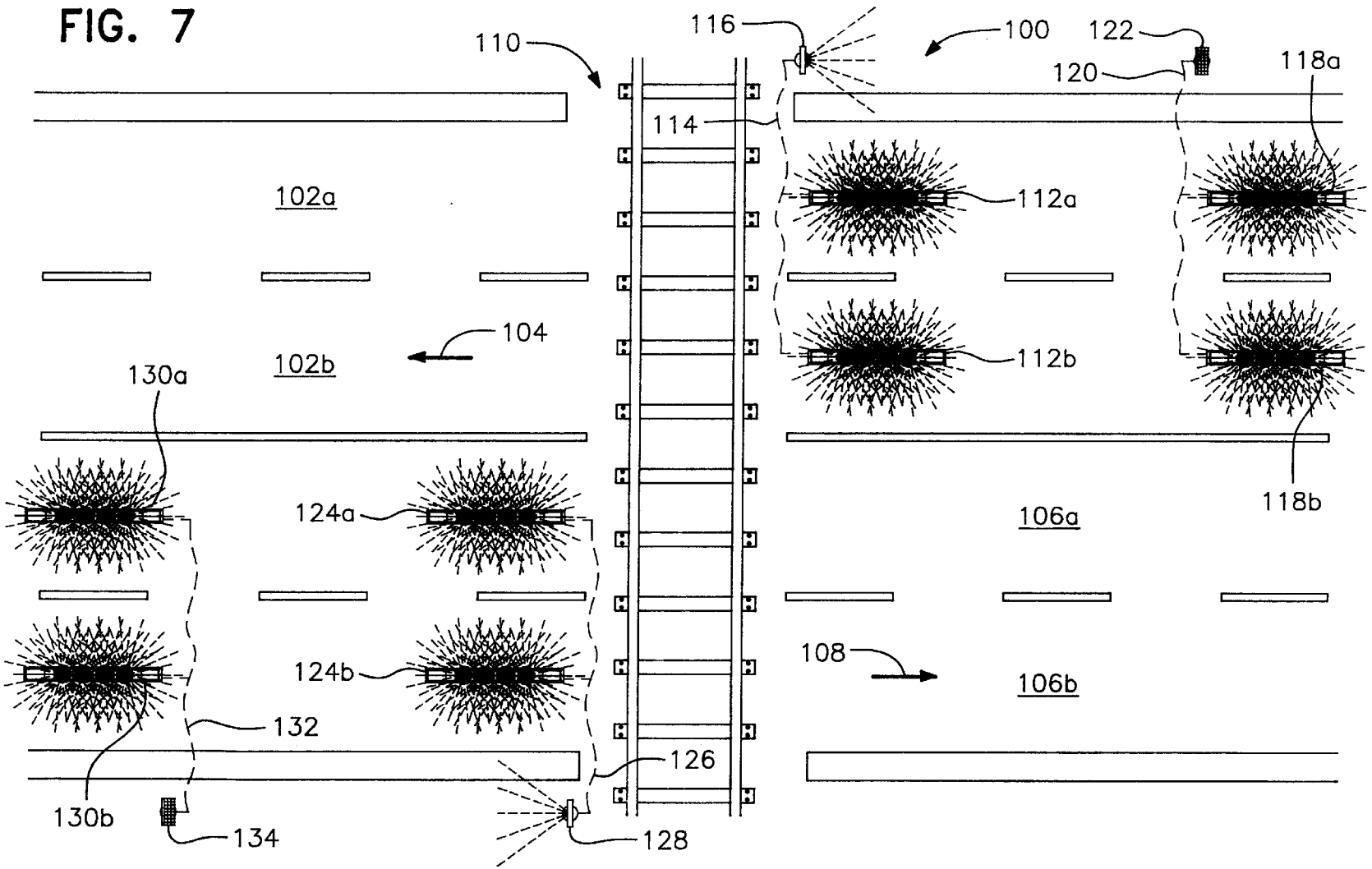
FIG. 7 is a plan view of a preferred highway warning system of the present invention according to the present invention illustrating two rows of two light troughs in each direction of travel with each light trough located in a center of a lane of traffic.

With reference to FIG. 7, traffic travels along roadway 100 having two lanes 102(*a*), 102(*b*) traveling in the direction of arrow 104. On the opposite side of the highway 100 are two lanes of traffic 106(*a*) , 106(*b*) having traffic traveling in the direction of arrow 108. Both lanes of traffic cross over a set of railroad. tracks 110.

Positioned in the highway 100, in a center of lanes 102(*a*), 102(*b*) , respectively, are light emitting troughs 112(*a*), 112(*b*). These troughs 112(*a*), 112(*b*) are electrically connected by wire 114 to a railroad crossing warning light 116. The power for the crossing light 116 is used to activate the crossing troughs 112(*a*), 112(*b*), synchronized with the flashing of the warning light 116.

Spaced downstream in the direction of travel 104 from the two light troughs 112(*a*), 112(*b*) are an additional two light troughs positioned respectively in lanes 102(*a*), 102(*b*). The two additional light troughs 118(*a*), 118(*b*) are connected by wire 120 to a solar panel charging device 122 for powering the light troughs 118(*a*), 118(*b*).

The light troughs 118(*a*) , 118(*b*) include an amber colored filter to provide a warning to oncoming motorists driving in the direction of arrow 104 of a potentially dangerous crossing which is rapidly approaching. The light troughs 112(*a*), 112(*b*) have a red colored light filter to flash a stop or emergency warning to l1o oncoming traffic traveling in the direction of arrow 104.

Both sets of light troughs 112(*a*), 112(*b*) and 118(*a*), 118(*b*) are positioned having their longitudinal axes extending parallel to the direction of travel in lanes 102(*a*), 102(*b*). In addition, all four light troughs are positioned respectively in the center of their respective lane of traffic 102(*a*), 102(*b*) The parallel positioning of the light trough in the center of the roadway has proven to be extremely advantageous in alerting oncoming traffic to a potentially dangerous situation ahead.

The length of each trough is three to twelve feet long. In the illustration, four strobe lights are located in each trough. However, it is envisioned as being within the scope of the present invention that as many as nine strobe lights could be positioned in each trough.

The arrangement of the light troughs parallel to the direction of travel along a roadway and in the center of each roadway provides an increased depth of flashing light as compared to troughs which are positioned perpendicular to the direction of oncoming traffic. Therefore, the longer the light trough is extending parallel to the direction of travel, the more light that is presented to oncoming traffic.

As additionally shown in FIG. 7, on the opposite side of the roadway, having lanes 106(*a*), 106(*b*), are two light troughs 124(*a*), 124(*b*) respectively connected by wire 126 to warning signal 128. Also, two additional light troughs 130(*a*), 130(*b*) are connected by wire 132 to solar panel recharging system 134. As was done in lanes 102(*a*), 102(*b*) the successive rows of light troughs in lanes 106(*a*), 106(*b*) include amber light filters in light is troughs 130(*a*), 130(*b*) and red light filters in light troughs 124(*a*), 124(*b*).

Figure 8:
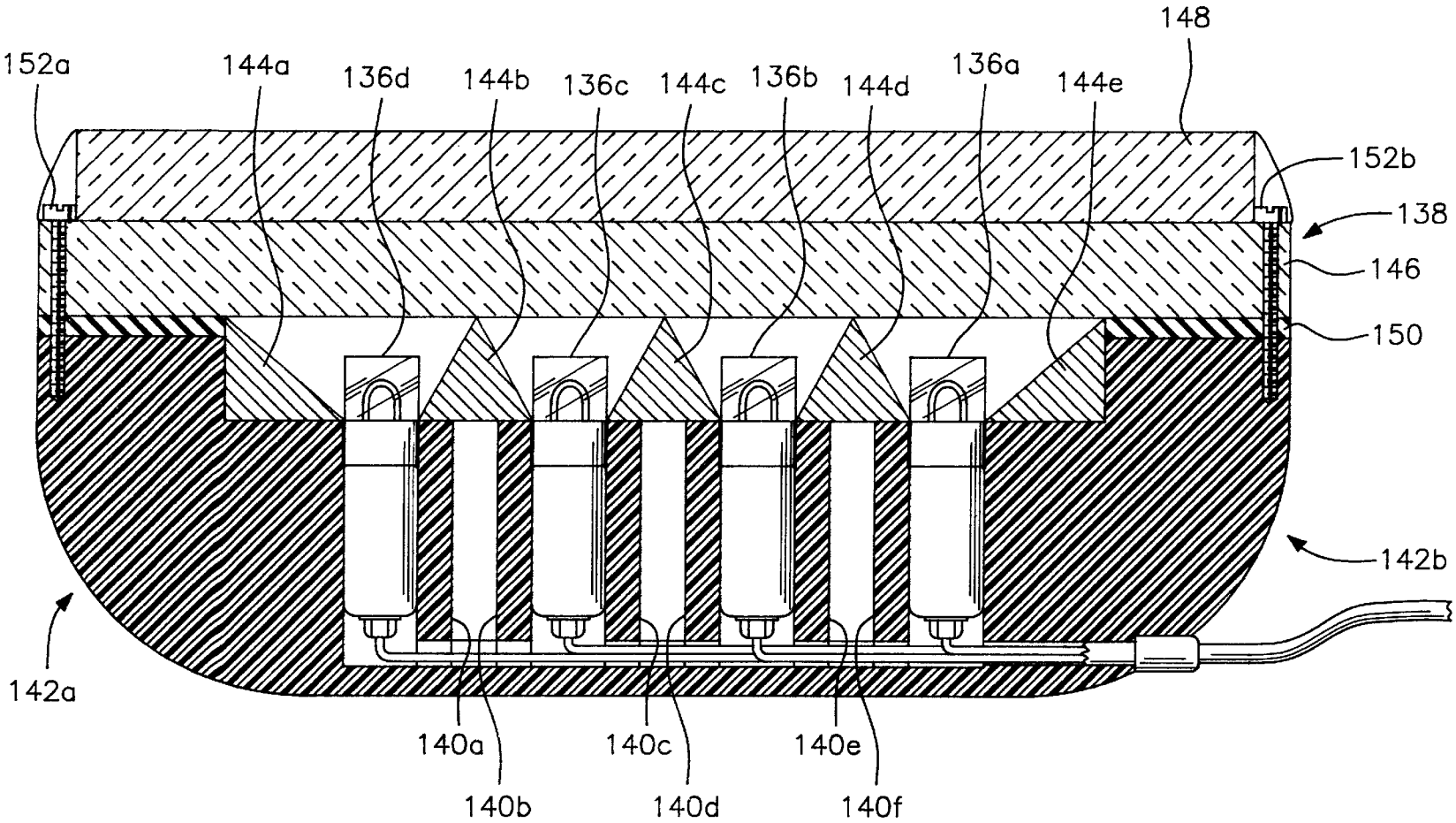
FIG. 8 is a partial cross sectional view of an exemplary light trough having curved end portions.

With reference to FIG. 8, the details of a single light trough are shown. In this embodiment, four strobe lights 136(*a*), 136(*b*), 136(*c*) and 136(*d*) are spaced along the length of a light trough 138. Each strobe light is hermetically sealed from an adjacent strobe light by interdispersed partitions 140(*a*) , 140(*b*), 140(*c*) , 140(*d*) , 140(*e*) and 140(*f*). Rounded end walls 142(*a*), 142(*b*) facilitate sealing of the end strobe lights 136(*a*) , 136(*d*).

Also, the curvature of the end walls 142(*a*) , 142(*b*) facilitate the placement of the light trough 138 in a ditch having a width of three to twelve inches. This width corresponds to the width of a ditch for the light trough 138 which is dug with an excavation tool, such as a back hoe. This ditch has naturally formed curved ends rather than requiring further manual excavation to square off the end walls of the ditch. The light trough 138 of the present invention accommodates the curved end walls of the ditch for placement therein of the light trough with relatively minor manual labor.

Each light trough 138 includes triangular reflective portions 144(*a*), 144(*b*), 144(*c*), 144(*d*) and 144(*e*) having one or two reflective surfaces depending upon the positioning of the reflective portions 144(*a*) through 144(*e*). The strobe lights 136(*a*) through 136(*d*) emit flashes of white light which are reflected off the reflective portions 144(*a*) through 144(*e*) to pass through transparent plastic layer 146 and alternately through transparent or translucent plastic layer 148. A rubber gasket 150 seals the end wall portions 142(*a*), 142(*b*) with the layer 146 as secured by bolts 152(*a*), 152(*b*)

Figure 9:
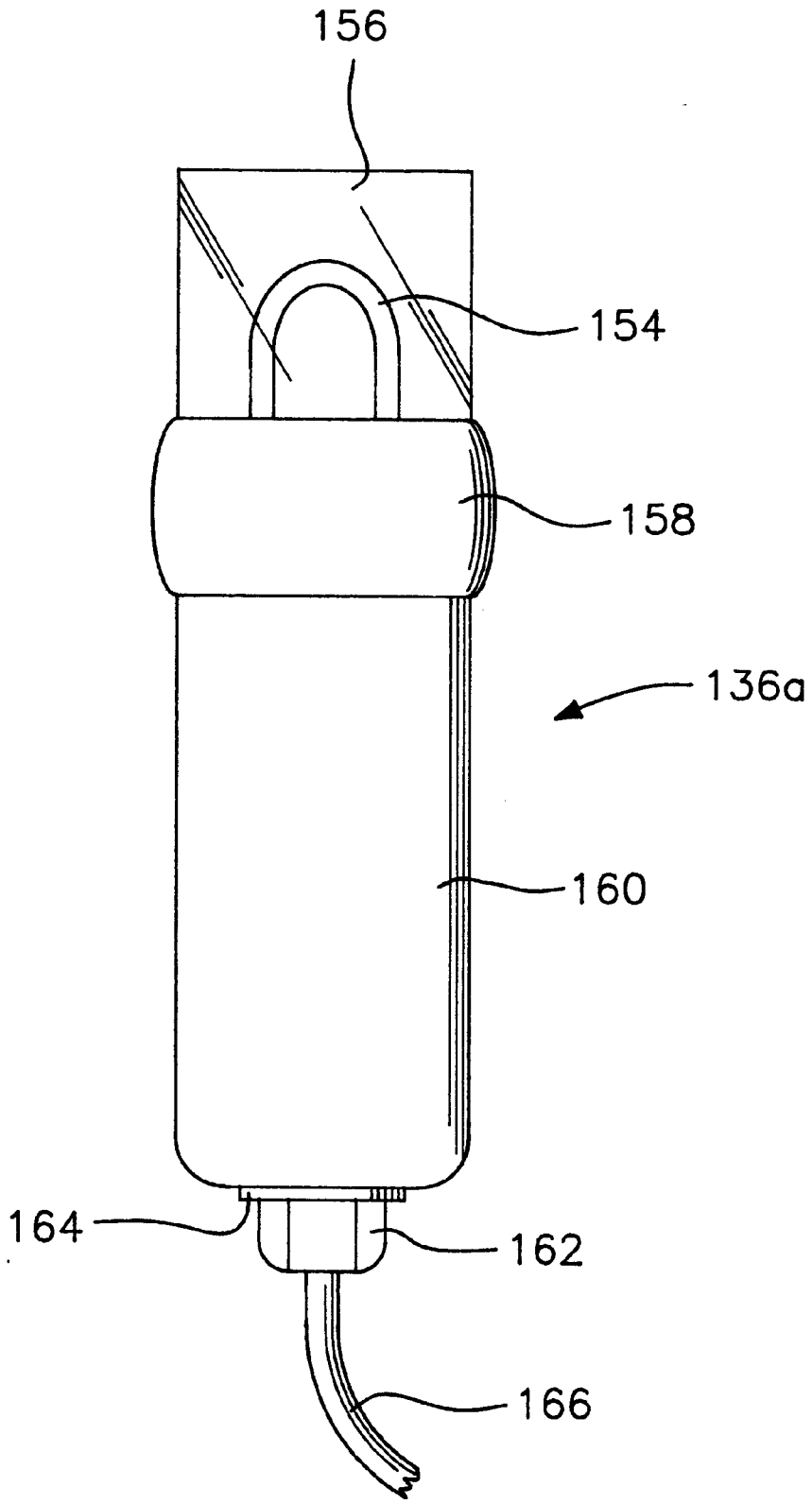
FIG. 9 is a side view of a strobe light used in, the light trough of the present invention.

With reference to FIG. 9, a single strobe light 136(*a*), for example, will be described. The energization of an electric filament 154, produces a flash of light. A plastic encasing cap 156, can be transparent, or colored, such as amber or red to affect the color of light emitted by the strobe light 136(*a*) to be white, yellow or red.

A heat shrink wrap seal 158 unites the lens 156 and the plastic body 160 of the light 136(*a*). A plastic nut 162 pressing against a water type seal washer 164, provides a waterproof access of an electric wire 166 to the interior of the light. Each light forms a waterproof unit which, upon failure, can be replaced without affecting the workings of the additional light units contained within a light trough.

According to the present invention a highway warning system provides a visual warning to oncoming traffic of a potentially hazardous situation and, in the instances where the highway warning system acts as a speed bump, to elevate and lower the wheels of oncoming traffic, a physical warning is conveyed to oncoming traffic to the potentially hazardous situation ahead.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A highway warning system comprising:

an elongated, rectangular shaped container open at one side, said container being divided into a plurality of interior sections, said container being positionable below grade level of a road, a plurality of strobe lights located in said interior sections of said container, and a cover sealing said one side of said container, said cover projecting to at least the grade level and allowing light to pass from within said container to outside of said container.

2. A highway warning system as claimed in claim 1, wherein said sections of said container are lined with a reflective material.

3. A highway warning system as claimed in claim 1, wherein said sections are isolated from each other to prevent environmental contamination of one section from spreading to an adjacent section.

4. A highway warning system as claimed in claim 1, wherein an exterior surface of said cover is continuously curved so as to form a speed bump in a flow of traffic.

5. A highway warning system as claimed in claim 4, wherein said cover is transparent.

6. A highway warning system as claimed in claim 4, wherein said cover is translucent.

7. A highway warning system as claimed in claim 1, wherein a colored filter causes a colored light to be emitted by the strobe lights.

8. A highway warning system comprising:

a road having traffic traveling in a predetermined direction, an electrical signal device located along a side of the road, said electrical signal device having a power source, an elongated container buried in the road, said container being open at one side, a plurality of lights located in said container, said lights being electrically connected to the power source for the electrical signal device and said lights being actuated simultaneously with said electrical signal device to provide a coordinated effort to alert oncoming traffic of a potentially hazardous situation, and a cover sealing said one side of said container, said cover projecting to at least the grade level of the road and allowing light to be transmitted from the plurality of lights for visually alerting oncoming traffic to said potentially hazardous situation.

9. A highway warning system as claimed in claim 8, wherein said lights are strobe lights.

10. A highway warning system as claimed in claim 9, wherein a colored filter causes a colored light to be emitted by the strobe lights.

11. A highway warning system as claimed in claim 8, wherein said container is lined with reflective material.

12. A highway warning system as claimed in claim 8, wherein an exterior surface of said cover is continuously curved for elevating and lowering wheels of oncoming traffic to physically alert oncoming traffic to the potentially hazardous situation.

13. A highway warning system as claimed in claim 12, wherein said container is positioned parallel to the predetermined direction.

14. A highway warning system as claimed in claim 12, wherein said container is positioned perpendicular to the predetermined direction.

15. A highway warning system comprising:

a road having traffic traveling in a predetermined direction, at least one elongated, rectangular shaped container buried in a pathway of the road so that vehicles traveling on the road must pass over said at least one container, said at least one container having a longitudinal axis extending parallel to the predetermined direction, said at least one container allowing light to pass through one side, a source of electrical energy located along the road and spaced from the at least one elongated, rectangular shaped container, a plurality of strobe lights located in said container, said lights being electrically connected to said source of electrical energy, said lights being energized simultaneously with an exterior signal device located along the road also energized by said source of electrical energy, and a cover sealing said one side of said container and allowing passage of light therethrough.

16. A highway warning system as claimed in claim 15, wherein two successive rows of containers are located in said road.

17. A highway warning system as claimed in claim 16, wherein one container in one row includes an amber light filter and the other container in the other row includes a red light filter.

18. A highway warning system as claimed in claim 15, wherein four strobe lights are located in said container.

19. A highway warning system as claimed in claim 15, wherein said cover hermetically seals said container to prevent entry of moisture.

20. A highway warning system comprising:

a container open at one side, said container being divided into a plurality of sections, said container being positionable below grade level, a plurality of lights located in said sections of said container, and a cover sealing said one side of said container, said cover projecting to at least the grade level and allowing light to pass from within said container to outside of said container, an exterior surface of said cover being continuously curved so as to form a speed bump in a flow of traffic.

21. A highway warning system comprising:

a road having traffic traveling in a predetermined direction, an electrical signal device located along a side of the road, said electrical signal device having a power source, a container buried in the road, said container being open at one side, a plurality of lights located in said container, said lights being electrically connected to the power source for the electrical signal device, and a cover sealing said one side of said container, said cover projecting to at least the grade level of the road and allowing light to be transmitted from the plurality of lights for visually alerting oncoming traffic to a potentially hazardous situation, an exterior surface of said cover being continuously curved for elevating and lowering wheels of oncoming traffic to physically alert oncoming traffic to the potentially hazardous situation.

* * * * *